US011118336B1

(12) United States Patent
Alonzo et al.

(10) Patent No.: US 11,118,336 B1
(45) Date of Patent: Sep. 14, 2021

(54) FOOT ACTUATED TOILET FLUSHING DEVICE

(71) Applicants: Carlos Alonzo, San Fernando, CA (US); Irving De La Cruz, San Fernando, CA (US)

(72) Inventors: Carlos Alonzo, San Fernando, CA (US); Irving De La Cruz, San Fernando, CA (US)

( * ) Notice: Subject to any disclaimer, the term of this patent is extended or adjusted under 35 U.S.C. 154(b) by 0 days.

(21) Appl. No.: 16/801,916

(22) Filed: Feb. 26, 2020

(51) Int. Cl.
*E03D 5/08* (2006.01)

(52) U.S. Cl.
CPC ..... *E03D 5/08* (2013.01)

(58) Field of Classification Search
CPC ..... A47K 13/10; A47K 3/28; E03C 1/052; E03D 5/08
See application file for complete search history.

(56) References Cited

U.S. PATENT DOCUMENTS 1,589,353 A * 6/1926 Bock ..... E03D 5/08 137/362
1,614,346 A * 1/1927 Coret ..... E03D 5/08 4/249
3,883,904 A * 5/1975 Wittman ..... E03D 5/08 4/249
5,056,165 A 10/1991 Wescott
5,142,708 A 9/1992 Johnson
5,170,513 A 12/1992 Ambooken
5,339,468 A 8/1994 Lin
D354,802 S 1/1995 Bigelow
6,601,241 B1 * 8/2003 Skotzke ..... A47K 13/10 4/246.1
6,651,262 B1 11/2003 Tinsley
6,718,562 B1 4/2004 Saragas
7,003,815 B2 * 2/2006 Herbst ..... E03D 5/08 4/246.1
8,214,933 B1 7/2012 Gaudin
8,286,273 B1 * 10/2012 Toomer ..... E03D 5/08 4/249
10,226,155 B2 * 3/2019 Helfrich ..... A47K 13/10

* cited by examiner

*Primary Examiner* — David P Angwin
*Assistant Examiner* — Nicholas A Ros

(57) ABSTRACT

A foot actuated toilet flushing device for hands free toilet flushing includes a bracket, a pedal assembly, and a cable assembly. The bracket is mountable to a tank of a toilet proximate to a handle of the toilet. A connector is engaged to the bracket and is connectable to the handle of the toilet. The pedal assembly is mountable to a floor proximate to the toilet. The cable assembly is coupled to and extends between the connector and the pedal assembly. The pedal assembly can be pressed by a foot of a user, positioning the cable assembly to transfer a downward force applied to the pedal assembly to the handle of the toilet to flush the toilet.

13 Claims, 4 Drawing Sheets

FOOT ACTUATED TOILET FLUSHING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toilet flushing devices and more particularly pertains to a new toilet flushing device for hands free toilet flushing.

(2) Description of Related Art Including Information Disclosed Under 37 CFR 1.97 and 1.98

The prior art relates to toilet flushing devices. Prior art toilet flushing devices may comprise a cord, a rod, or a chain engaged to a handle of a toilet, and having a pedal engaged thereto distal from the handle. The pedal may be suspended above or rest upon a floor proximate to the toilet and is actuated by a foot of a user.

BRIEF SUMMARY OF THE INVENTION

An embodiment of the disclosure meets the needs presented above by generally comprising a bracket, a pedal assembly, and a cable assembly. The bracket is configured to be mountable to a tank of a toilet proximate to a handle of the toilet. A connector is engaged to the bracket and is configured to be connected to the handle of the toilet. The pedal assembly is configured to be mountable to a floor proximate to the toilet. The cable assembly is coupled to and extends between the connector and the pedal assembly. The pedal assembly is configured to be pressed by a foot of a user, positioning the cable assembly to transfer a downward force applied to the pedal assembly to the handle of the toilet to flush the toilet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
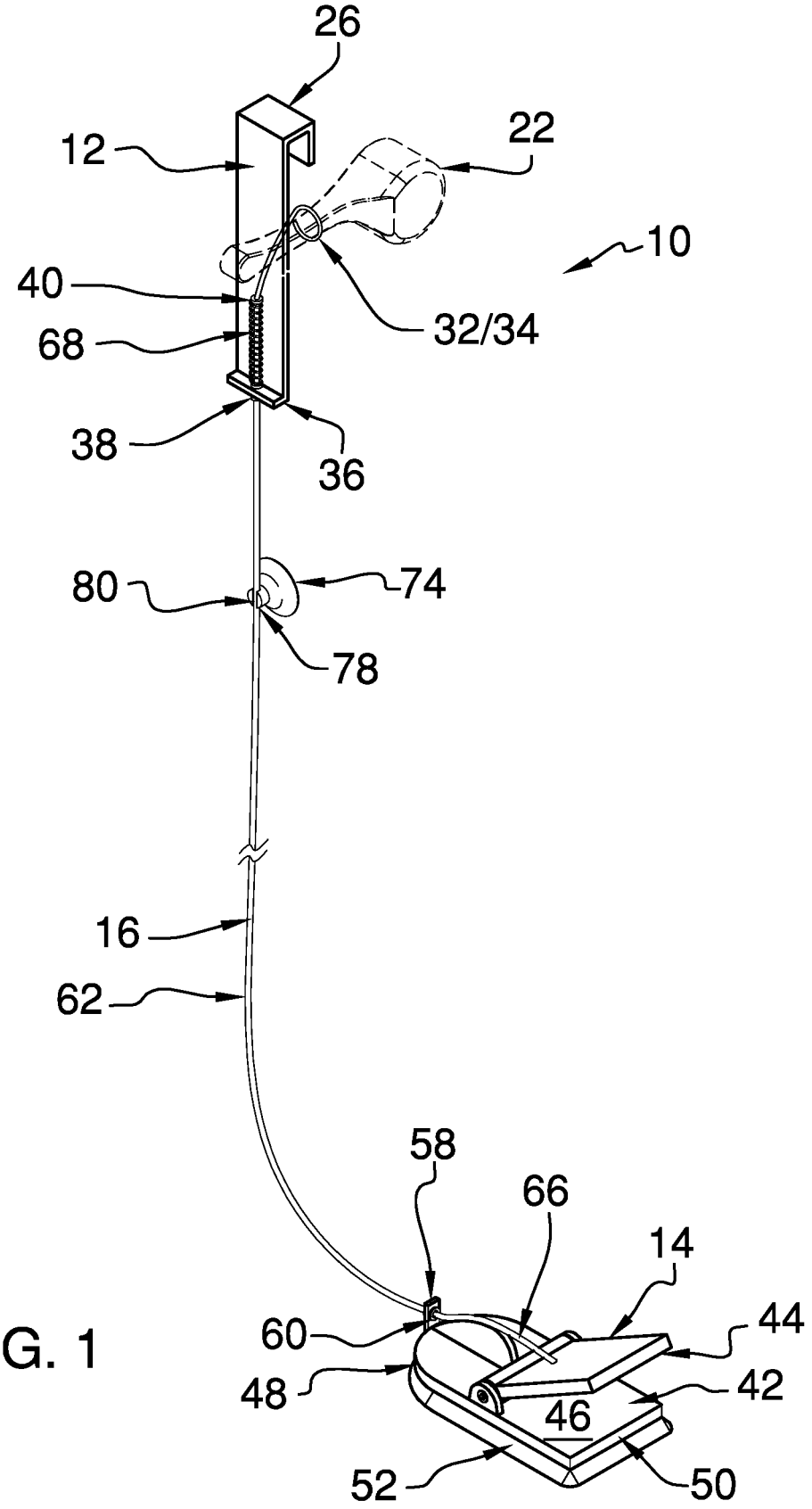
FIG. 1 is an isometric perspective view of a foot actuated toilet flushing device according to an embodiment of the disclosure.

With reference now to the drawings, and in particular to FIGS. 1 through 4 thereof, a new toilet flushing device embodying the principles and concepts of an embodiment of the disclosure and generally designated by the reference numeral 10 will be described.

Figure 2:
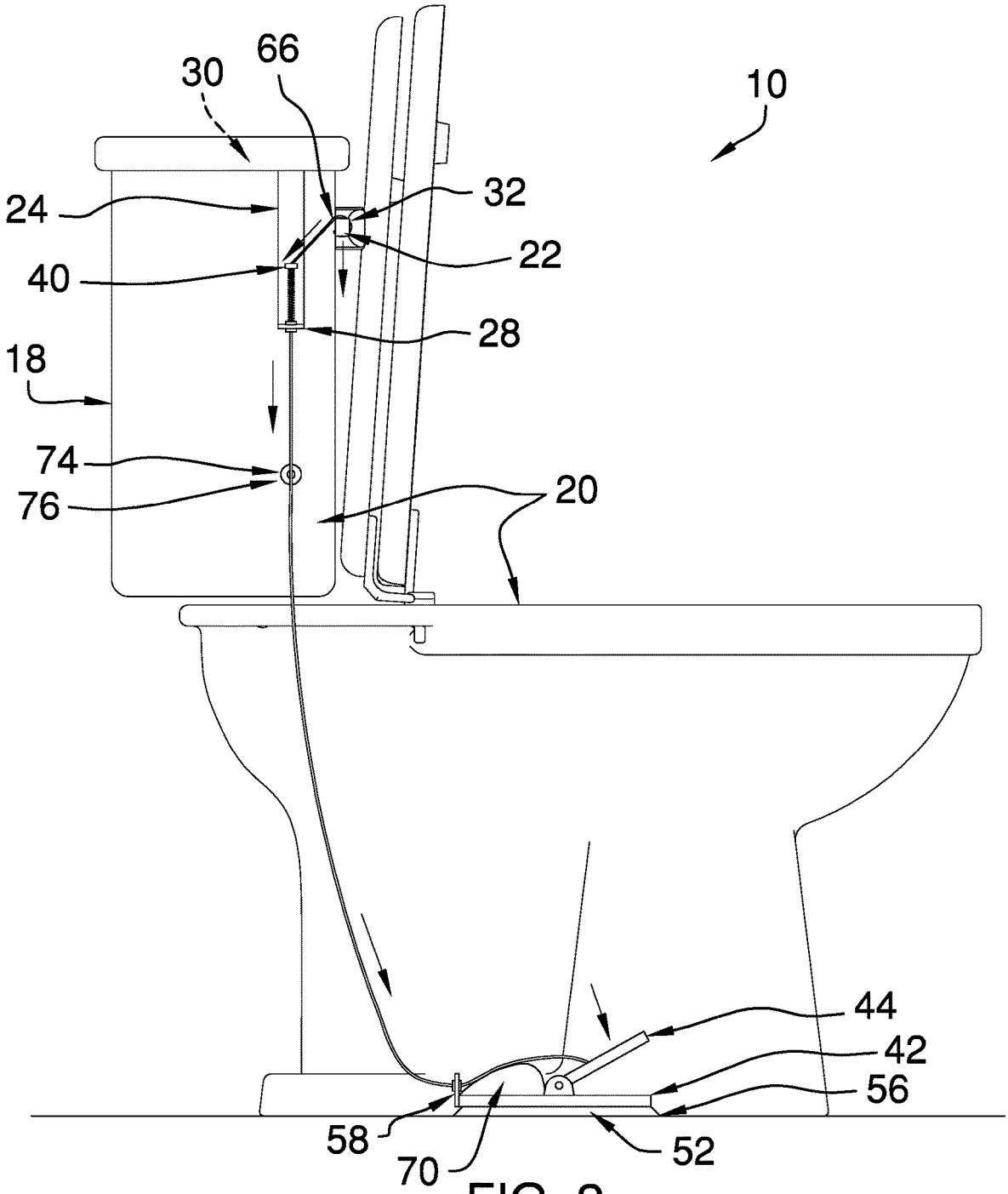
FIG. 2 is an in-use view of an embodiment of the disclosure.

As best illustrated in FIGS. 1 through 4, the foot actuated toilet flushing device 10 generally comprises a bracket 12, a pedal assembly 14, and a cable assembly 16. The bracket 12 is configured to be mountable to a tank 18 of a toilet 20 proximate to a handle 22 of the toilet 20. The bracket 12 comprises a bar 24, which has an upper end 26 and a lower end 28. The bar 24 is hook shaped proximate to the upper end 26, such that the upper end 26 of the bar 24 is configured to hook to a lip 30 of the tank 18 of the toilet 20, as shown in FIG. 2.

Figure 3:
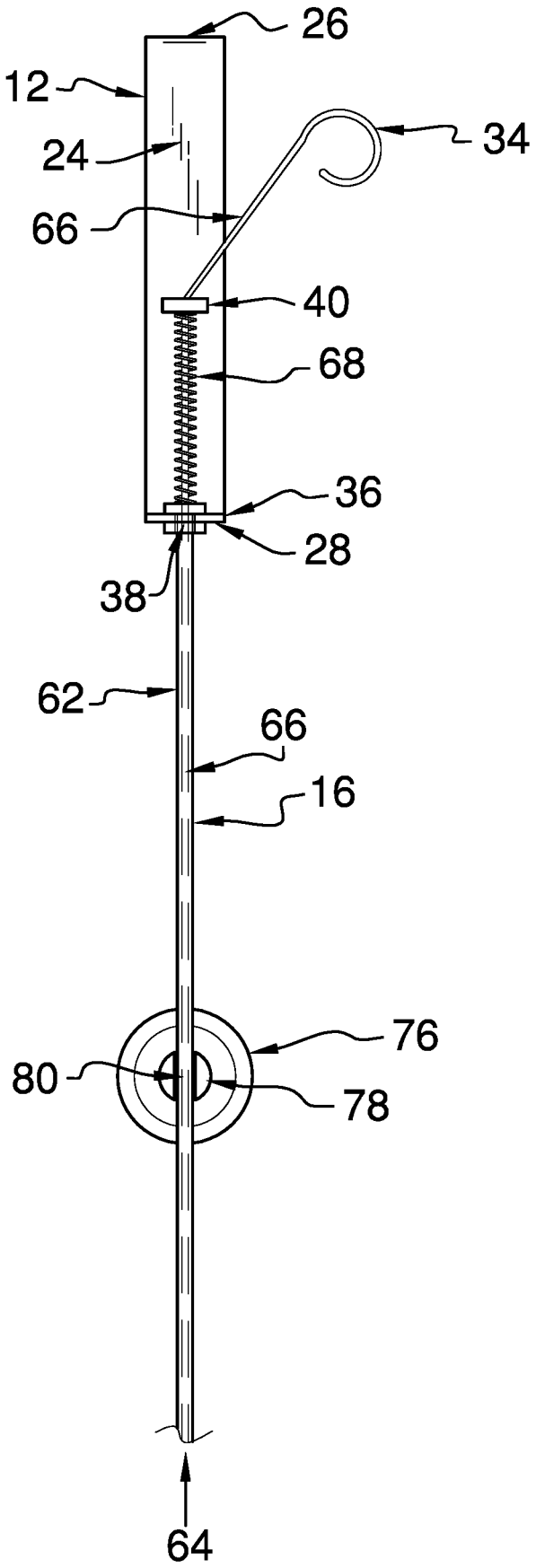
FIG. 3 is a detail view of an embodiment of the disclosure.
Figure 4:
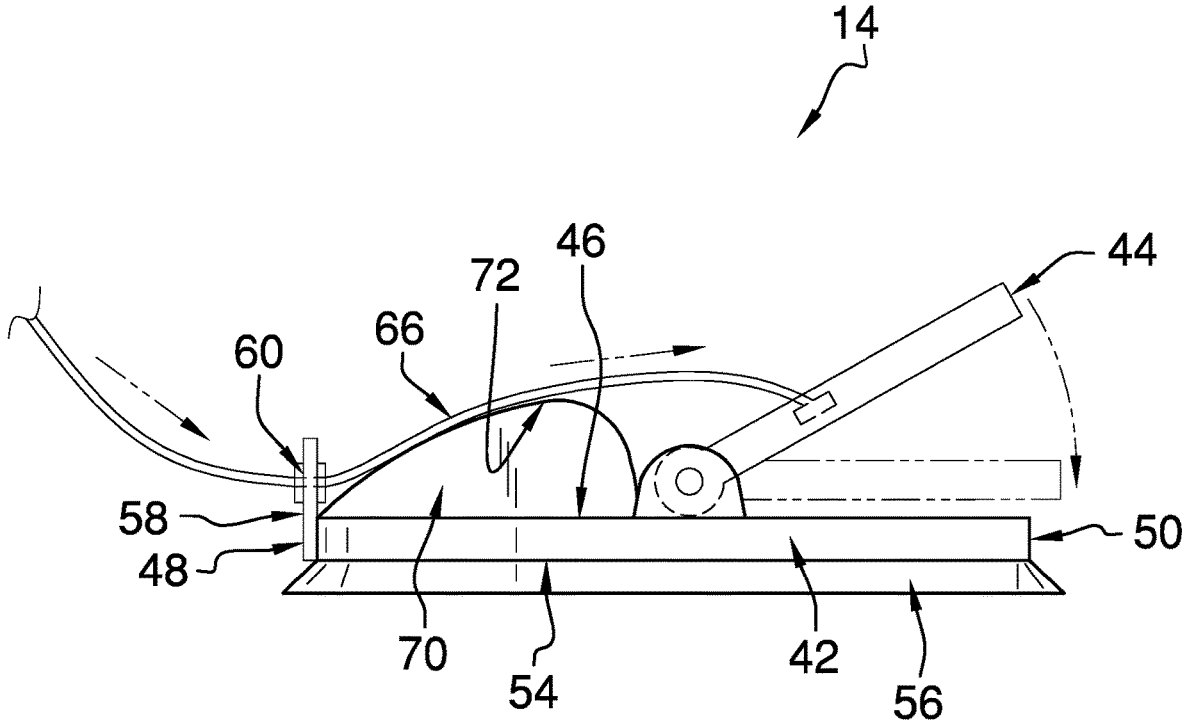
FIG. 4 is a detail view of an embodiment of the disclosure.

A connector 32 is engaged to the bracket 12 and is configured to be connected to the handle 22 of the toilet 20. The connector 32 may comprise a clip 34, as shown in FIG. 3, or other connecting means, such as, but not limited to, zip ties, hose clamps, and the like.

The pedal assembly 14 is configured to be mountable to a floor proximate to the toilet 20. The cable assembly 16 is coupled to and extends between the connector 32 and the pedal assembly 14. The pedal assembly 14 is configured to be pressed by a foot of a user, positioning the cable assembly 16 to transfer a downward force applied to the pedal assembly 14 to the handle 22 of the toilet 20 to flush the toilet 20.

The lower end 28 of the bar 24 has a rim 36 engaged thereto and extending substantially perpendicularly therefrom. The rim 36 has a first hole 38 positioned therethrough. A ring 40 is coupled to the bar 24 between the rim 36 and the upper end 26. The ring 40 extends from the bar 24 codirectionally with the rim 36.

The pedal assembly 14 comprises a first plate 42 and a second plate 44, which is pivotally engaged to an upper face 46 of the first plate 42 substantially equally distant from a front edge 48 and a rear edge 50 of the first plate 42. A plate fastener 52 is engaged to a lower face 54 of the first plate 42 and is configured to fasten the first plate 42 to the floor proximate to the toilet 20. The plate fastener 52 may comprise a floor cup 56, which is resiliently compressible. The floor cup 56 is configured to be pressed between the first plate 42 and the floor to suctionally fasten the first plate 42 to the floor, as shown in FIG. 2. The plate fastener 52 also may comprise other fastening means, such as, but not limited to, adhesives, screws, and the like.

A tab 58 is coupled to and extends substantially perpendicularly from the upper face 46 of the first plate 42 proximate to the front edge 48 of the first plate 42. The tab 58 has a second hole 60 positioned therethrough. The cable assembly 16 comprises a sheath 62, which is coupled to the rim 36 and the tab 58 and which extends between the first hole 38 and the second hole 60. The sheath 62 is substantially non-compressible along a longitudinal axis 64 thereof. A wire 66 is positioned through the sheath 62 and extends through the first hole 38 and the second hole 60. The wire 66 is coupled to the connector 32 and the second plate 44.

A spring 68 is positioned around the wire 66 between the rim 36 and the ring 40. The spring 68 is coupled to the wire 66 distal from the rim 36. The spring 68 biases the second plate 44 to a ready position, as shown in FIG. 1, wherein the second plate 44 is transverse to the first plate 42 and positioned to be depressed by the foot of the user. The spring 68 is configured to be tensioned as the second plate 44 is depressed toward the first plate 42 by the foot of the user to flush the toilet 20. The spring 68 is configured to rebound, upon removal of the foot of the user from the second plate 44, to return the second plate 44 to the ready position.

A wedge 70 is coupled to the upper face 46 of the first plate 42 and is positioned between the tab 58 and the second plate 44. The wedge 70 has an upper surface 72, which extends arcuately from the first plate 42 proximate to the tab 58, such that the upper surface 72 is distal from the first plate 42 proximate to the second plate 44. The wire 66 is positioned over the wedge 70. The wedge 70 effectively multiplies a length of travel on the wire 66 relative to movement of the second plate 44 so that the wire 66 travels far enough to actuate the handle 22.

The device 10 also comprises a cable fastener 74, which is configured to be mountable to the tank 18 of the toilet 20 and to be selectively engageable to the sheath 62. The cable fastener 74 retains the sheath 62 proximate to the tank 18, as shown in FIG. 2. The cable fastener 74 may comprise a cable cup 76, which has a protrusion 78 coupled thereto. The cable cup 76 and the protrusion 78 are resilient. The cable cup 76 is configured to be pressed against the tank 18 to couple it thereto. The protrusion 78 extends from the cable cup 76 and has a slot 80 positioned therein. The slot 80 is positioned to insert the sheath 62 to engage the sheath 62 to the protrusion 78. The cable fastener 74 may comprise other fastening means, such as, but not limited to, hook and loop fasteners, tape, and the like.

In use, the bracket 12 is hooked to the lip 30 of the tank 18 proximate to the handle 22 of the toilet 20. The clip 34 is connected to the handle 22. The pedal assembly 14 is positioned on the floor proximate to the toilet 20. Pressure is applied to the first plate 42 to compress the floor cup 56 to suctionally engage the pedal assembly 14 to the floor. The user then is positioned to depress the second plate 44 to flush the toilet 20, as needed and without using a hand on the handle 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A foot actuated toilet flushing device comprising:

a bracket configured to be mountable to a tank of a toilet proximate to a handle of the toilet, wherein the bracket comprises a bar having an upper end and a lower end, the bar being hook shaped proximate to the upper end, wherein the upper end of the bar is configured for hooking to a lip of the tank of the toilet;

a connector engaged to the bracket and being configured to be connected to the handle of the toilet;

a pedal assembly configured to be mountable to a floor proximate to the toilet;

a cable assembly coupled to and extending between the connector and the pedal assembly, wherein the pedal assembly is configured for pressing by a foot of a user, positioning the cable assembly for transferring a downward force applied to the pedal assembly to the handle of the toilet for flushing the toilet;

the lower end of the bar having a rim engaged thereto and extending perpendicularly therefrom, the rim having a first hole positioned therethrough;

a ring coupled to the bar between the rim and the upper end, the ring extending from the bar codirectionally with the rim;

the pedal assembly comprising:

a first plate, a second plate pivotally engaged to an upper face of the first plate equally distant from a front edge and a rear edge of the first plate, a plate fastener engaged to a lower face of the first plate and being configured for fastening the first plate to the floor proximate to the toilet, and a tab coupled to and extending perpendicularly from the upper face of the first plate proximate to the front edge of the first plate, the tab having a second hole positioned therethrough; and the cable assembly comprising:

a sheath coupled to the rim and the tab and extending between the first hole and the second hole, the sheath being non-compressible along a longitudinal axis thereof, a wire positioned through the sheath and extending through the first hole and the second hole, the wire being coupled to the connector and the second plate, and a spring positioned around the wire between the rim and the ring, the spring being coupled to the wire distal from the rim, such that the spring biases the second plate to a ready position wherein the second plate is transverse to the first plate, wherein the spring is configured for tensioning as the second plate is depressed toward the first plate by the foot of the user concurrent with the wire transferring the downward force to the handle of the toilet for flushing the toilet, and wherein the spring is configured for rebounding, upon removal of the foot of the user from the second plate, for returning the second plate to the ready position.

2. The foot actuated toilet flushing device of claim 1, wherein the connector comprises a clip.

3. The foot actuated toilet flushing device of claim 1, wherein the plate fastener comprises a floor cup, the floor cup being resiliently compressible, wherein the floor cup is configured for pressing between the first plate and the floor for suctionally fastening the first plate to the floor.

4. The foot actuated toilet flushing device of claim 1, further including:

a wedge coupled to the upper face of the first plate and positioned between the tab and the second plate, the wedge having an upper surface, the upper surface extending arcuately from the first plate proximate to the tab, such that the upper surface is distal from the first plate proximate to the second plate; and the wire being positioned over the wedge.

5. The foot actuated toilet flushing device of claim 1, further including a cable fastener configured to be mountable to the tank of the toilet and to be selectively engageable to the sheath such that the sheath is retained proximate to the tank.

6. The foot actuated toilet flushing device of claim 5, wherein the cable fastener comprises a cable cup having a protrusion coupled thereto, the cable cup and the protrusion being resilient, wherein the cable cup is configured for pressing against the tank for coupling it thereto, the protrusion extending from the cable cup and having a slot positioned therein, such that the slot is positioned for inserting the sheath for engaging the sheath to the protrusion.

7. A toilet and foot actuated toilet flushing device combination comprising:

a toilet comprising a tank having a handle engaged thereto for flushing the toilet;

a bracket mounted to the tank of the toilet proximate to the handle, wherein the bracket comprises a bar having an upper end and a lower end, the bar being hook shaped proximate to the upper end and hooked to a lip of the tank of the toilet;

a connector engaged to the bracket and connected to the handle of the toilet;

a pedal assembly configured to be mountable to a floor proximate to the toilet;

a cable assembly coupled to and extending between the connector and the pedal assembly, wherein the pedal assembly is configured for pressing by a foot of a user, positioning the cable assembly for transferring a downward force applied to the pedal assembly to the handle of the toilet for flushing the toilet;

the lower end of the bar having a rim engaged thereto and extending perpendicularly therefrom, the rim having a first hole positioned therethrough;

a ring coupled to the between the rim and the upper end, the ring extending from the bar codirectionally with the rim;

the pedal assembly comprising:

a first plate, a second plate pivotally engaged to an upper face of the first plate equally distant from a front edge and a rear edge of the first plate, a plate fastener engaged to a lower face of the first plate and being configured for fastening the first plate to the floor proximate to the toilet, and a tab coupled to and extending perpendicularly from the upper face of the first plate proximate to the front edge of the first plate, the tab having a second hole positioned therethrough; and the cable assembly comprising:

a sheath coupled to the rim and the tab and extending between the first hole and the second hole, the sheath being non-compressible along a longitudinal axis thereof, a wire positioned through the sheath and extending through the first hole and the second hole, the wire being coupled to the connector and the second plate, and a spring positioned around the wire between the rim and the ring, the spring being coupled to the wire distal from the rim, such that the spring biases the second plate to a ready position wherein the second plate is transverse to the first plate, wherein the spring is configured for tensioning as the second plate is depressed toward the first plate by the foot of the user concurrent with the wire transferring the downward force to the handle of the toilet for flushing the toilet, and wherein the spring is configured for rebounding upon removal of the foot of the user from the second plate, for returning the second plate to the ready position.

8. The toilet and foot actuated toilet flushing device combination of claim 7, wherein the connector comprises a clip.

9. The toilet and foot actuated toilet flushing device combination of claim 7, wherein the plate fastener comprises a floor cup, the floor cup being resiliently compressible, wherein the floor cup is configured for pressing between the first plate and the floor for suctionally fastening the first plate to the floor.

10. The foot actuated toilet flushing device of claim 7, further including:

a wedge coupled to the upper face of the first plate and positioned between the tab and the second plate, the wedge having an upper surface, the upper surface extending arcuately from the first plate proximate to the tab, such that the upper surface is distal from the first plate proximate to the second plate; and the wire being positioned over the wedge.

11. The toilet and foot actuated toilet flushing device combination of claim 7, further including a cable fastener mounted to the tank of the toilet and to engaged to the sheath such that the sheath is retained proximate to the tank.

12. The foot actuated toilet flushing device of claim 11, wherein the cable fastener comprises a cable cup having a protrusion coupled thereto, the cable cup and the protrusion being resilient, the cable cup being suctionally mounted to the tank, the protrusion extending from the cable cup and having a slot positioned therein, the sheath such that being positioned in the slot.

13. A foot actuated toilet flushing device comprising:

a bracket configured to be mountable to a tank of a toilet proximate to a handle of the toilet, the bracket comprising a bar having an upper end and a lower end, the bar being hook shaped proximate to the upper end, wherein the upper end of the bar is configured for hooking to a lip of the tank of the toilet, the lower end having a rim engaged thereto and extending perpendicularly therefrom, the rim having a first hole positioned therethrough;

a ring coupled to the bar between the rim and the upper end, the ring extending from the bar codirectionally with the rim;

a connector engaged to the bracket and being configured to be connected to the handle of the toilet, the connector comprising a clip;

a pedal assembly configured to be mountable to a floor proximate to the toilet, the pedal assembly comprising:

a first plate, a second plate pivotally engaged to an upper face of the first plate equally distant from a front edge and a rear edge of the first plate, a plate fastener engaged to a lower face of the first plate and being configured for fastening the first plate to the floor proximate to the toilet, the plate fastener comprising a floor cup, the floor cup being resiliently compressible, wherein the floor cup is configured for pressing between the first plate and the floor for suctionally fastening the first plate to the floor, a tab coupled to and extending substantially perpendicularly from the upper face of the first plate proximate to the front edge of the first plate, the tab having a second hole positioned therethrough, and a wedge coupled to the upper face of the first plate and positioned between the tab and the second plate, the wedge having an upper surface, the upper surface extending arcuately from the first plate proximate to the tab, such that the upper surface is distal from the first plate proximate to the second plate;

a cable assembly coupled to and extending between the connector and the pedal assembly, wherein the pedal assembly is configured for pressing by a foot of a user, positioning the cable assembly for transferring a downward force applied to the pedal assembly to the handle of the toilet for flushing the toilet, the cable assembly comprising:

a sheath coupled to the rim and the tab and extending between the first hole and the second hole, the sheath being non-compressible along a longitudinal axis thereof, a wire positioned through the sheath and extending through the first hole and the second hole, the wire being coupled to the connector and the second plate, the wire being positioned over the wedge, and a spring positioned around the wire between the rim and the ring, the spring being coupled to the wire distal from the rim, such that the spring biases the second plate to a ready position wherein the second plate is transverse to the first plate, wherein the spring is configured for tensioning as the second plate is depressed toward the first plate by the foot of the user concurrent with the wire transferring the downward force to the handle of the toilet for flushing the toilet, and wherein the spring is configured for rebounding, upon removal of the foot of the user from the second plate, for returning the second plate to the ready position; and a cable fastener configured to be mountable to the tank of the toilet and to be selectively engageable to the sheath such that the sheath is retained proximate to the tank, the cable fastener comprising a cable cup having a protrusion coupled thereto, the cable cup and the protrusion being resilient, wherein the cable cup is configured for pressing against the tank for coupling it thereto, the protrusion extending from the cable cup and having a slot positioned therein, such that the slot is positioned for inserting the sheath for engaging the sheath to the protrusion.

* * * * *